United States Patent [19]

Weiner et al.

[11] 4,215,277

[45] Jul. 29, 1980

[54] SEQUENCING LIGHT CONTROLLER

[75] Inventors: Robert I. Weiner, 4 Chartwell Ct., Owings Mills, Md. 21117; W. Roger Sauter, Baltimore, Md.

[73] Assignee: Robert I. Weiner, Towson, Md.

[21] Appl. No.: 10,796

[22] Filed: Feb. 9, 1979

[51] Int. Cl.[2] ..... H05B 37/00

[52] U.S. Cl. ..... 307/41; 307/115; 307/132 R; 315/323; 315/211

[58] Field of Search ..... 307/132 R, 132 E, 115, 307/41, 11, 223 R; 328/70, 75, 77; 315/217, 294, 323, 360, 211

[56] References Cited

U.S. PATENT DOCUMENTS

| | | | |
|---|---|---|---|
| 3,934,249 | 1/1976 | Sanjana | 315/211 |
| 4,016,474 | 4/1977 | Mason | 307/41 |

OTHER PUBLICATIONS

Disco Lights Elektor, Sep. 1975, pp. 924–926.

*Primary Examiner*—L. T. Hix
*Assistant Examiner*—S. D. Schreyer
*Attorney, Agent, or Firm*—Colton & Stone, Inc.

[57] ABSTRACT

A controller for sequentially energizing a plurality of lights, such as commercial display lighting or Christmas tree light strings, includes a plurality of outlet receptacles into which the lights or light strings may be connected, a Triac for each receptacle to control the energization thereof, a timing circuit and a programmable gating circuit responsive to the timing circuit and generating gating signals for the Triacs according to any of several predetermined sequential combinations.

24 Claims, 7 Drawing Figures

SEQUENCING LIGHT CONTROLLER

BACKGROUND OF THE INVENTION

The present invention pertains to circuitry for sequentially energizing a plurality of lights and, more particularly, to such circuitry possessing the capability of being programmed to provide a number of different lighting sequences.

Among the uses which are contemplated for the circuitry of the present invention are the controlling of a plurality of strings of Christmas tree lights, the controlling of lights used in commercial displays, such as store window displays, and the controlling of other decorative lighting arrangements.

To enhance the aesthetic effect of decorative and display lighting, it is often desirable to provide for the blinking or flashing of the lights. For example, it is a common practice to provide, with Christmas tree lights of the series type, for each set of series lights one bulb which includes a thermally responsive switch to cause the lights of that particular series to flash or blink. With the use of individual thermally responsive switching for each light string, however, the flashes of the individual strings are purely random relative to the other strings and it is not possible to create selected patterns or sequences in the blinking of the light strings.

Sequencing controllers which employ mechanically operated switches have been proposed for the control of multiple strings of decorative lights. Examples of such controls may be found in U.S. Pat. Nos. 2,878,424, Barker; 3,808,450, Davis Jr.; 3,862,434, Davis, Jr.; and 4,057,735, Davis, Jr. Sequencing controllers of this type, however, employ motor driven cam operated switches and are, of necessity, of fairly large size. Where the sequencing controller is used to control the lights of a Christmas tree, many people find the use of a large size control unit to be objectional as such a unit is not easily concealed and, thus, detracts from the desired decorative effect. Also, the mechanical sequencing controllers of the prior art are generally designed to provide but a single sequence for the plural light strings.

Another approach to controlling a display of decorative lighting suggested by the prior art is that disclosed in U.S. Pat. No. 3,793,531, Ferrigno. In the approach adopted in this patent, a solid-state control circuit is employed with the display lights being switched on and off by means of a Triac which is gated by means of an oscillator circuit to turn on and off at selected portions of the half cycles of a standard 60 Hz alternating current signal. Here again, however, only a limited sequence is provided. Another approach to the control of plural display lights also using solid-state circuitry is taught in the article "Solid-State Ring Counters and Chasers for Light Displays" A. A. Adem, *Electronics World,* September 1967, pp. 84–85. In this circuit each light or series of lights is controlled by a solid-state switching device such as a Triac or an SCR and the switching device is, in turn, gated by a stepping circuit so that the lights are triggered in a predetermined but fixed sequence. A similar sequencing controller for display lights is disclosed in U.S. Pat. No. 3,934,249, Sanjana.

It is the primary object of the present invention to provide a sequencing light controller employing solid-state circuitry and having the capability of providing a number of different sequences readily selectable by the user.

A further object of the present invention is the provision of a sequencing light controller which may be housed in a compact unit so as to be unobtrusive when used in connection with decorative displays or Christmas tree lighting.

Yet another object of the present invention is the provision of a sequencing light controller having the capability of controlling a plurality of strings or banks of lights.

BRIEF DESCRIPTION OF THE INVENTION

The above and other objects of the invention which will become apparent hereinafter are achieved by the provision of a sequencing light controller having a plurality of electric outlets to which individual light strings may be connected, a Triac or equivalent solid-state switching device for connecting each of the outlets to an AC power source, a gating circuit for each Triac, a timing circuit, and a logic circuit having a plurality of output sequences connected to the gating circuits and controlled by the timing circuit to provide selective sequential energization of the Triacs and, accordingly, light means connected thereto.

For a more complete understanding of the invention and the objects and advantages thereof, reference should be had to the following detailed description and the accompanying drawings wherein preferred embodiments of the invention are described and shown.

DETAILED DESCRIPTION OF THE PREFERRED EMBODIMENTS

Figure 1:
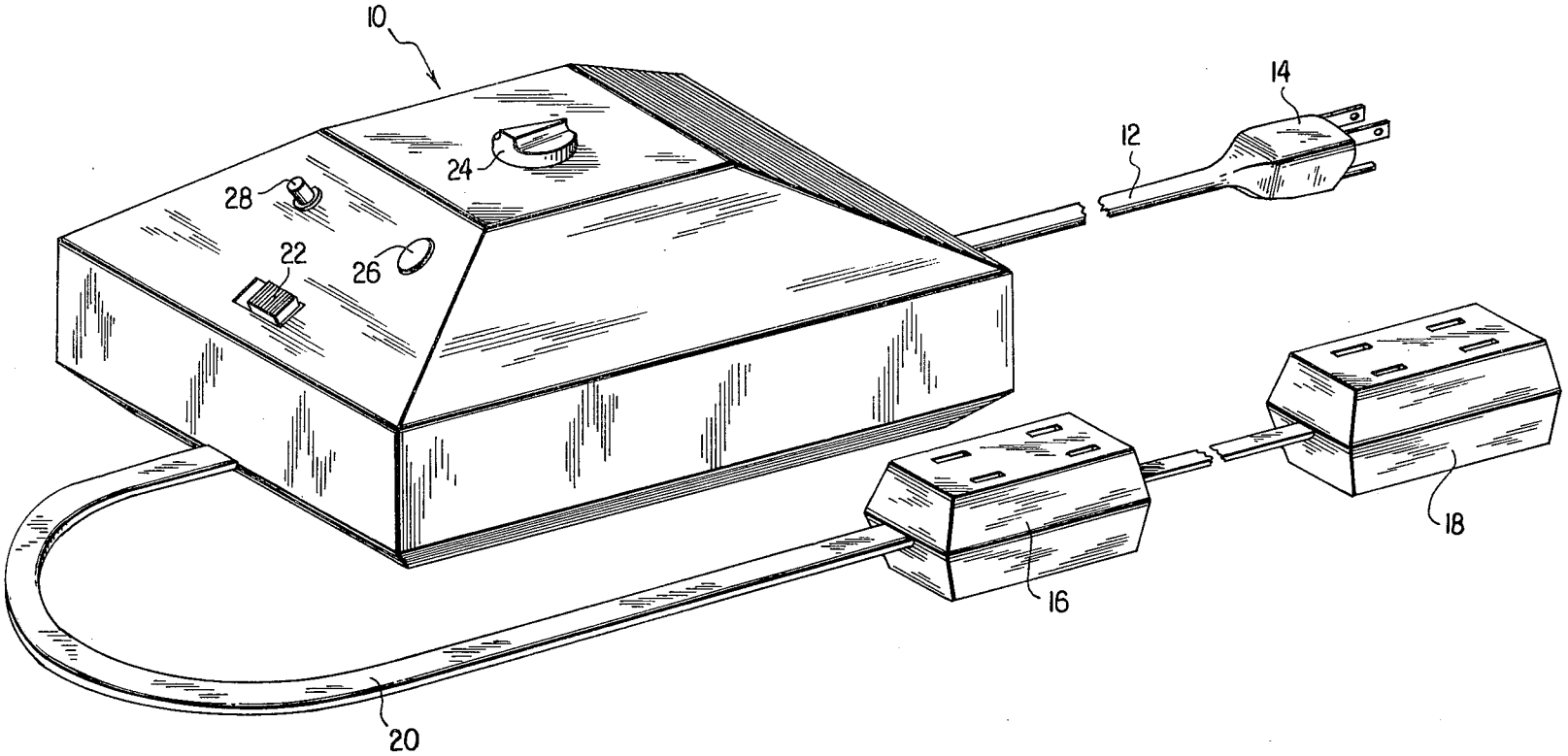
FIG. 1 is a perspective view of the first embodiment of the light sequencing controller of the present invention.

The light sequencing controller illustrated in FIG. 1 includes a housing 10 containing the sequencing control circuitry to be hereinafter described and is provided with a power cord 12 having a plug 14 for connection to a standard 110 volt 60 Hz outlet. A plurality of outlet receptacles 16 and 18 are connected to the housing 10 by a multiconductor cable 20. The housing 10 also includes an on-off switch 22, a sequencing mode selector switch 24, an indicator light 26 and a circuit breaker reset button 28.

Figure 3:
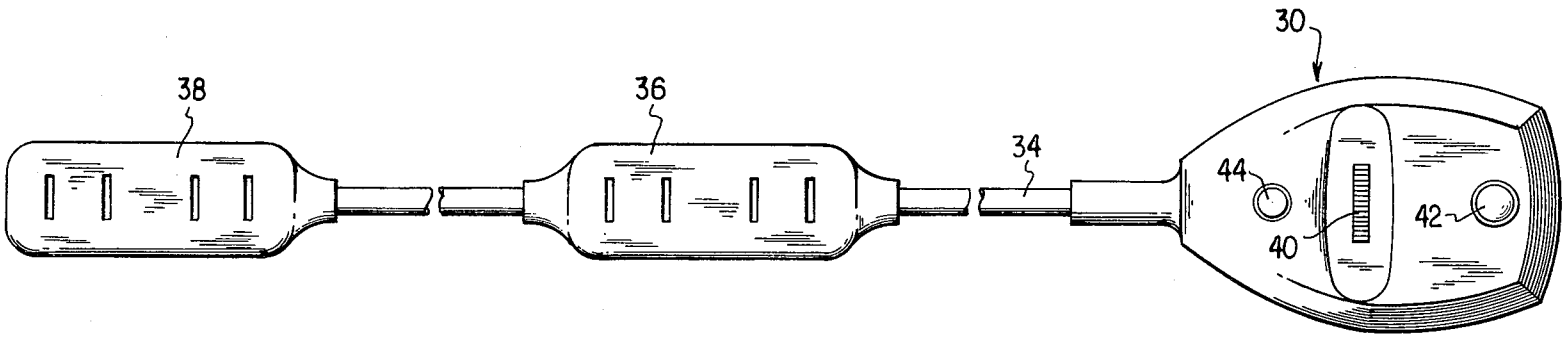
FIG. 3 is a top plan view of the embodiment of FIG. 2.
Figure 2:
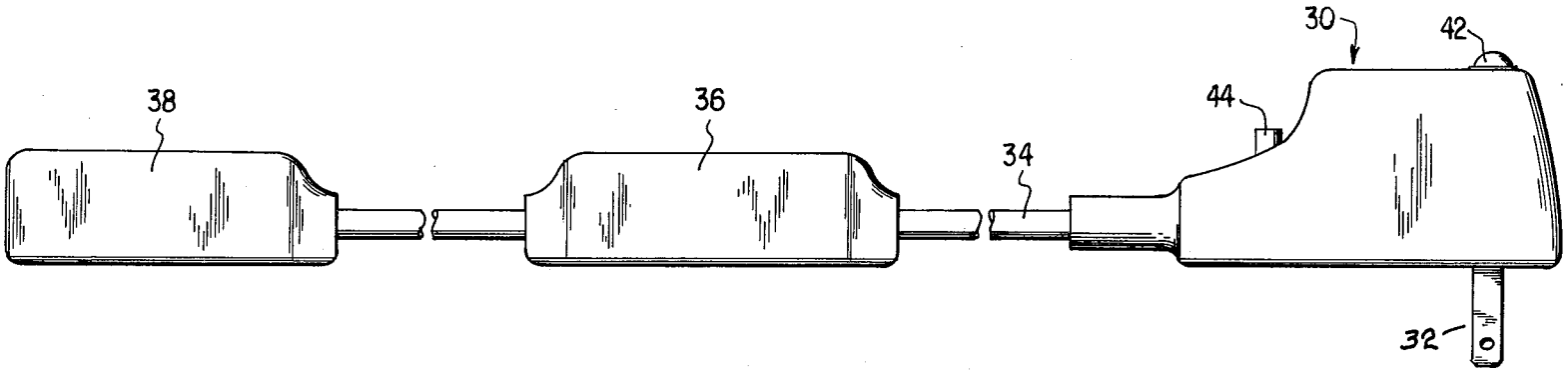
FIG. 2 is a side elevational view of a second embodiment of the sequencing controller.

In the embodiment illustrated in FIGS. 2 and 3, the housing 30 for the sequencing control circuitry is designed to be attached directly to an outlet receptacle, the electrical connecting prongs 32 projecting directly from the rear face of the housing 30. As with the previously described embodiment, multiple outlet receptacles 36 and 38 are connected to the housing 30 by means of a multiconductor cable 34. Projecting from the forward face of the housing are a switch 40 which may be a combined on-off and mode selecting switch, an indicator light 42 and a circuit breaker reset button 44.

Figure 4:
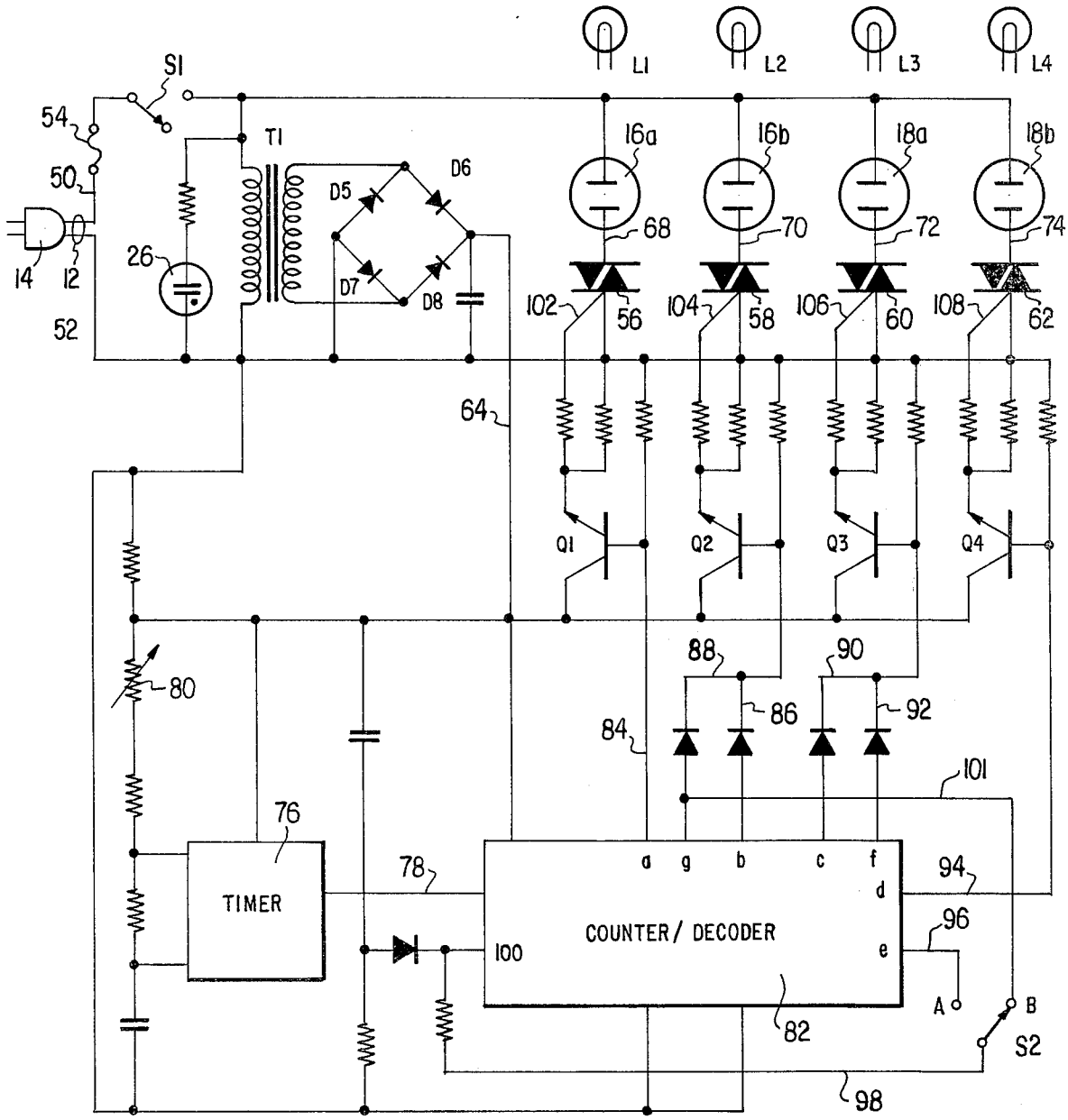
FIG. 4 is a schematic showing of one embodiment of the sequencing circuitry of the present invention.

One embodiment of the sequencing control circuitry which may be used with the assembly of FIG. 1 or that of FIGS. 2 and 3 is illustrated in FIG. 4. In this embodiment the power cord 12 connects to a pair of buses 50 and 52. The bus 52 includes a protective circuit breaker 54 and an on-off switch S1, which may be the switch 22 of FIG. 1 or a portion of the switch 40 of FIGS. 2 and 3. The bus 50 also connects to one conductor 66 of the multiple conductor cable 20 or 34 and is, in turn, connected to one side of each of the outlet receptacles 16A, 16B, 18A and 18B. The opposite sides of these receptacles are connected by means of conductors 68, 70, 72 and 74 to one main terminal of Triacs 56, 58, 60 and 62, respectively. The second main terminal of each of these Triacs is connected to the second bus 52. The conductors 68–74 constitute the remaining conductors of a multiple conductor cable. Also connected across power supply buses 50 and 52 is the primary of a transformer T1, the secondary of which furnishes, through a full wave rectifier constituted of the diodes D5–D8, a DC voltage in conductor 64 for the timing and sequencing control circuitry to be described below. An indicator light 26 is also connected across the buses 50 and 52. This indicator lamp may be a standard NE-2 neon pilot lamp.

The sequencing control circuitry includes a timer 76 which may be a linear integrated circuit timer manufactured by Signetics and designated part number NE555V. This timer functions as a stable oscillator with its frequency being controlled by means of the variable resistor 80. The timer functions to produce clock pulses in line 78 at uniform time intervals. The clock pulses over line 78 are provided as clock inputs to a counter/decoder 82 which may be a decade counter/divider manufactured by Motorola Semi-Conductors and designated part number MC14017B. This device has ten output terminals which are successively energized on successive clock pulses supplied to the device. In the present embodiment, only the first seven outputs a–f are employed. Upon initiation of a cycle the a output of a counter/decoder 82 is energized while outputs b–f are de-energized. When a clock pulse is transmitted over the line 78, the a output becomes de-energized and the b output energized. The a output of the counter/decoder is connected bia a conductor 84 to the base of a switching transistor Q1; the b and q outputs via conductors 86 and 88 to the base of switching conductor Q2; the c and f outputs via conductors 90 and 92 to the base of switching conductor Q3; and the d output via conductor 94 to the base of switching conductor Q4. Output e is connected to one terminal A of the switch S2, via the conductor 96. The g output is also connected, via a conductor 101 to the B terminal of the switch S2. The transistors Q1–Q4 furnish gating signals to Triacs 56–62, respectively, via conductors 102–108. The switch S2 is connected via conductor 98 to the reset input 100 of the counter/decoder 82.

Upon initiation of a sequencing cycle, the a output of the counter/decoder 82 provides a biasing signal to transistor Q1 turning this transistor on and furnishing a gating signal to Triac 56 so that Triac 56 conducts thereby energizing the lamp or series of lamps connected to the outlet **16*a*. When a clock pulse is transmitted from the timer 76 to the counter/decoder 82 the a output is de-energized turning transistor Q1 and Triac 56 off. At the same time, the b output is energized biasing transistor Q2 on and furnishing a gating signal to Triac 58. In like manner, outputs c and d are sequentially energized sequentially triggering on Triacs 60 and 62. If the switch S2 is in the A position the next succeeding clock pulse, causing the e output of the counter/decoder to be energized, furnishes a reset signal to the counter/decoder so that the next succeeding pulse again triggers the a output. When the switch S2 is in the B position, the e output terminal of the counter/decoder is disconnected and, upon receipt of the next clock pulse the f output is energized again biasing on transistor Q3 and the corresponding Triac 60. The next succeeding clock pulse causes the g output to turn on thereby turning on Triac 58. The g output signal is also supplied through conductor 101, switch S2 in the b position and conductor 98 to furnish a reset signal to the counter/decoder. Thus it will be seen that the circuit of FIG. 4 provides two sequences for the lamps commected to the outlets 16A, 16B, 18A and 18B. When the switch S2 is in the A position the lamps are energized in an L1, L2, L3, L4 and repeat sequence. In the B position, the lamps are energized in a sequence of L1, L2, L3, L4, L3, L2** and repeat. It will be understood that while for clarity in the drawings only a single lamp is shown as being associated with each of the outlet receptacles, in actual practice, a plurality of lamps would be associated with each receptacle. For example, an individual string of Christmas tree lights may be connected to each of the receptacles so that four strings of lights are controlled by the sequencer control circuit.

Figure 5:
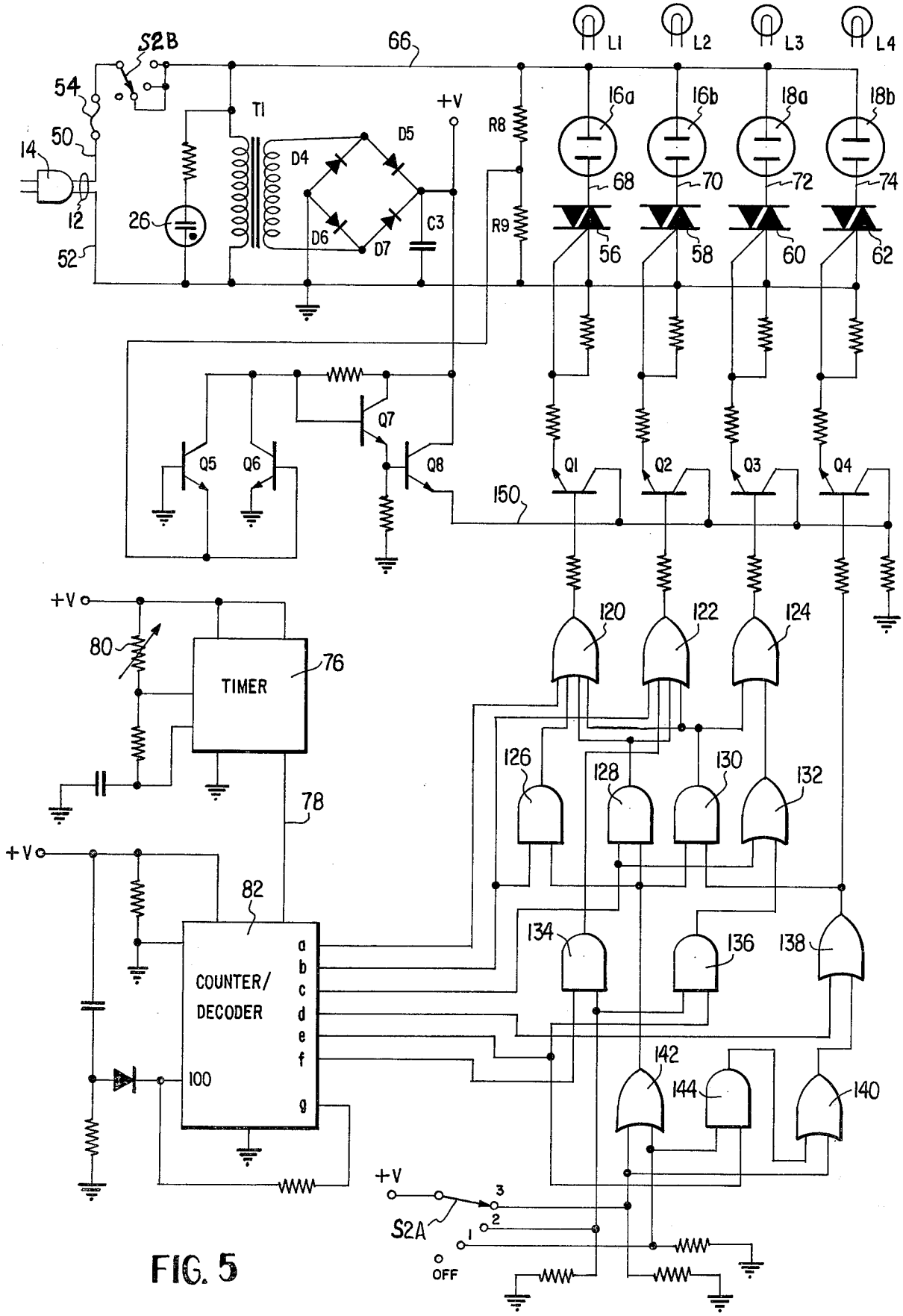
FIG. 5 is a schematic showing of a second embodiment of the sequencing circuitry.

The circuit embodiment disclosed in FIG. 5 provides two sequencing modes for controlling the lights connected to the outlet receptacles and a third mode in which all of the lights are energized. As in the previously described circuit, each of the outlet receptacles 16A, 16B, 18A and 18B is connected to the power supply buses through a Triac 56, 58, 60 and 62, respectively, and each Triac is gated by a corresponding switching transistor Q1, Q2, Q3 and Q4, respectively. Also as in the previously described embodiment, a timer 76 provides clock pulses via line 78 to a counter/decoder 82. The sequential outputs of the counter/decoder 82 are supplied to an array of logic elements 120–144 to determine the sequence of energization of lamps L1–L4. The mode selecting switch **S2*a* provides enabling signals to selected ones of the logic elements to determine the particular sequence. Thus, when the switch S2*a* is in the number 1 position, an enabling signal is provided to OR gate 142 and to one of the inputs of AND gate 144. The OR gate 142 furnishes enabling signals to one input of each of AND gates 126, 128 and 130. In this mode, the a output of the counter/decoder serves as an input to OR gate 120, turning this gate on to provide a signal to the base of transistor Q1. The b output of the counter/decoder is supplied to OR gate 122 which, in turn, supplies a signal to transistor Q2. The b output also provides an enabling signal to the first imput of AND gate 126 and, since the OR gate 142 also provides an enabling signal to the second input of AND gate 126, gate 126 furnishes an output signal to OR gate 120. Likewise, the c output provides a second enabling input to AND gate 128 so that an enabling signal is furnished to both gate 120 and 122. The c output signal is also coupled to the input of OR gate 132, the output of this gate furnishing an input to OR gate 124 to furnish a biasing signal to transistor Q3. At the next succeeding clock pulse, the d output of the counter/decoder is energized which provides an enabling signal to OR gate 138 to furnish a biasing signal to transistor Q4 and a second enabling signal to AND gate 130 which, in turn, furnishes enabling signals to OR gates 120, 122 and 124. The next output of the counter/decoder, at the e terminal, is furnished to AND gate 136. However, the second enabling signal to this gate is not present. The e output is also supplied to AND gate 144** which is receiving a second enabling signal through the switch S2*a*. Consequently, gate 144 furnishes an output signal to OR gate 140. Or gate 140 outputs to OR gate 138 again biasing transistor Q4 and, through gates 130 and 120–124, transistors Q1, Q2 and Q3. The f output signal of the counter/decoder is supplied to AND gate 134. This gate, however, is not energized as the second input terminal is grounded since switch S2*a* is in the one position. Consequently, no biasing signals are furnished to the transistors Q1–Q4 during the f output interval of the counter/decoder. At the next clock pulse supplied to the counter/decoder the g output is energized to furnish the reset signal to terminal 100.

The circuit of FIG. 5 also includes a zero crossing detector consisting of transistors Q5 and Q6 supplied by the voltage divider network R8, R9 connected across the AC buses 50 and 52. The zero crossing detector circuit serves to provide a positive going pulse at the point of zero crossing of the AC signal which pulse is amplified via transistors Q7 and Q8 to furnish a signal on line 150 to which the collectors of transistors Q1–Q4 are connected. This arrangement assures that the transistors Q1–Q4 will turn on, when provided with biasing signals from the respective OR gates, only at the point of zero crossing of the AC signal so that the corresponding Triacs 56–62 are also turned on only at the zero crossing point. An energized Triac will remain in that state until the AC current again goes to zero and no gating signal is supplied by the corresponding transistor. The provision of the zero crossing circuit serves to minimize radio frequency interference that would otherwise be caused by the switching on and off of the AC loads connected to the outlets 16A, 16B, 18A and 18B.

From the above description of the circuit 5, it will be apparent that when the switch S2*a* is in the 1 position, the lamps are illuminated in the sequence L1, L1L2, L1L2L3, L1L2L3L4, L1L2L3L4, OFF and repeat.

When the switch S2*a* is in the number 2 position, an enabling signal is provided to one terminal of each of AND gates 134 and 136. In this mode of operation, the a output of the counter/decoder 82 turns on OR gate 120; the b output turns on OR gate 122; the c output, gates 132 and 124; the d output, gate 138; the e output, gate 136 and gates 132 and 124; and the f output, gate 134 and gate 122. Thus, in this mode of operation the lamps are illuminated in the sequence L1, L2, L3, L4, L3, L2 and repeat.

The number 3 position of the switch S2*a* provides a full on position for all of the lamps independent of the operation of the timer 76 and counter/decoder 82. When the switch S2*a* is in the number 3 position enabling signals are provided to the OR gates 140 and 142. The signal of gate 142 provides enabling signals to AND gates 126, 128 and 130. The output signal of OR gate 140 provides and enabling signal to OR gate 138 which furnishes a second enabling signal to AND gate 130 and this gate, in turn, provides an enabling signal to each of OR gates 120, 122 and 124. Since gates 120, 122, 124 and 138 are all enabled, biasing signals are provided to each of the transistors Q1–Q4 at all times. Consequently, the four Triacs 56–62 are gated on at all times.

Figure 6:
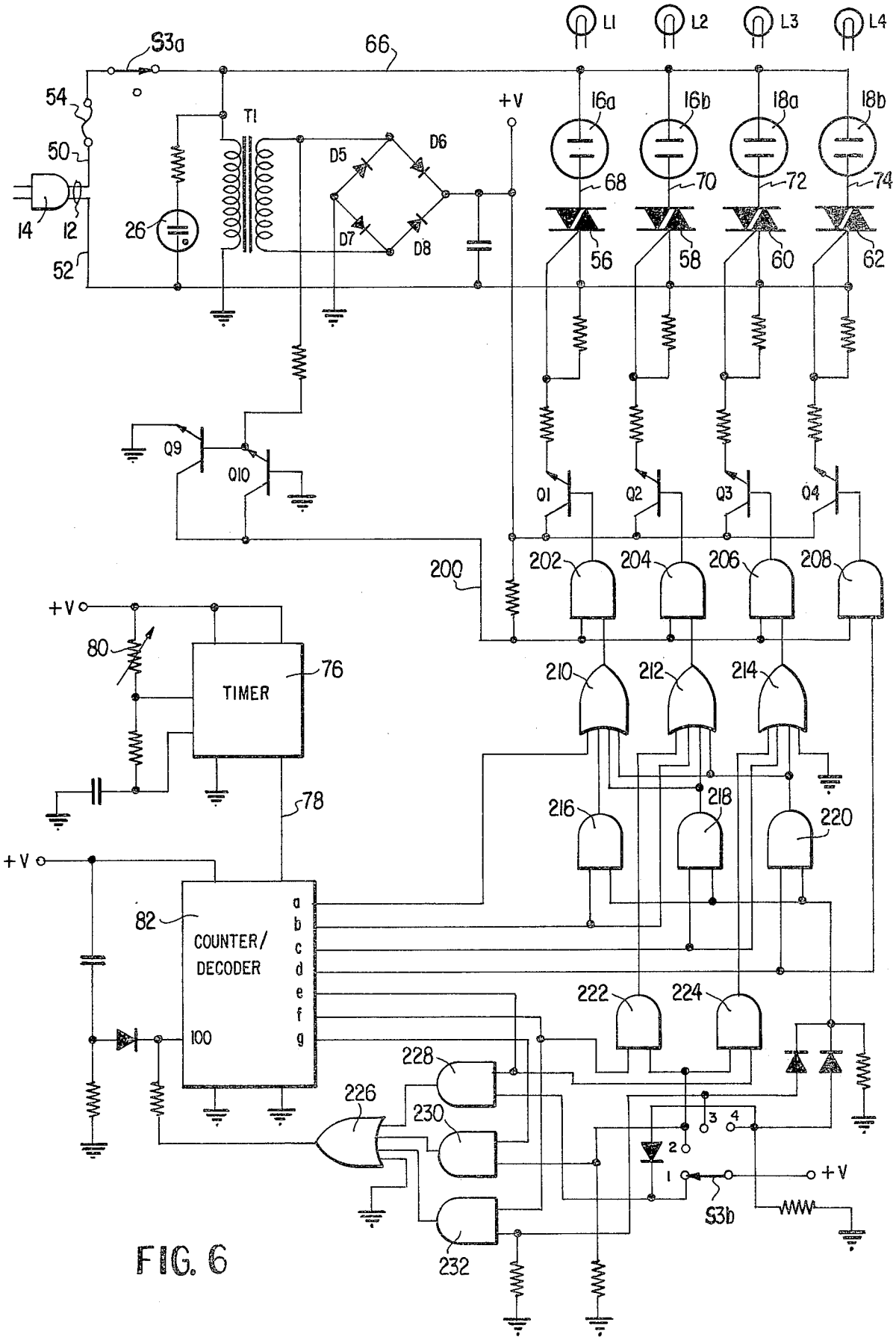
FIG. 6 is a schematic showing of another embodiment of the sequencing control circuitry.

In the circuit of FIG. 4, the mode selection switch determines the reset point for the counter/decoder circuit while in the circuit of FIG. 5 the mode selection switch programs a gating network to determine the sequence in which the Triacs are energized. FIG. 6 illustrates a circuit in which the mode selecting switch serves both of these functions. In this embodiment, OR gates 210–214 and AND gates 216–224 determine the sequencing pattern by which the Triacs 56–62 are gated on while OR gate 226 and AND gates 228–232 serve to determine the point during the sequence at which the reset signal is generated. This circuit also includes AND gates 202–208 which function in conjunction with a zero crossing detector circuit comprised of transistors Q9 and Q10 to pass gating signals to the transistors Q1–Q4 and, in turn, to the Triacs 56–62 only at the point of zero crossing of the AC power current. As in the previously described embodiment, the function of this circuit is to assure that the Triacs turn on at the point of zero crossing to minimize radio frequency interference.

When the mode selector switch S3*b* of the circuit of FIG. 6 is in the number 1 position, no enabling signals are provided to the AND gates 216–224. An enabling signal is provided to reset select AND gate 228. In this mode of operation the counter/decoder outputs a, b and c successively trigger on OR gates 210, 212 and 214, respectively, while the d output provides an enabling signal to AND gate 208. The e output of the counter/decoder is supplied to AND gate 228 which, in turn, triggers on OR gate 226 to furnish the reset signal to reset input 100 of counter/decoder 82. The sequence in this mode of operation is L1, L2, L3, L4 and repeat. At the mode 2 position of switch S3*b* an enabling signal is provided to the AND gates 222 and 224 and the reset select AND gate 230. In this mode of operation, the first four outputs of the counter/decoder, the a, b, c and d outputs, successively trigger on, via the appropriate gates, the Triacs 56, 58, 60 and 62, respectively. The e output provides a second enabling input to AND gate 224 to furnish an input to OR gate 214, again triggering on Triac 60. Likewise, the f output provides an enabling input to AND gate 222 to trigger on Triac 58 through OR gate 212. The g output of the counter/decoder coupled through AND gate 230 provides the reset signal to the counter/decoder 82. In the number 2 mode, therefore, the lamps are triggered in a sequence L1, L2, L3, L4, L3, L2 and repeat.

Enabling signals are provided to the AND gates 216, 218 and 220 and to reset select AND gate 232 when the switch S3*b* is in the mode 3 position. When operating in this mode, the a output of the counter/decoder 82 triggers on OR gate 210 to provide a gating signal for Triac 56. The b output signal of counter/decoder provides a second enabling input to AND gate 216 so that this gate outputs again turning on OR gate 210 and triggering on Triac 56. The b output signal also triggers on OR gate 212 to trigger on Triac 58. The c output from the counter/decoder provides the second enabling input to AND gate 218 which outputs to turn on OR gates 210 and 212. The c output also triggers on OR gate 214 so that at this stage Triacs 56, 58 and 60 are provided with gating signals. Likewise, the d output provides the second enabling input to AND gate 220 and this gate outputs to turn on OR gates 210, 212 and 214 while the d output is also supplied, through AND gate 208, to gate on Triac 62. As the e output is supplied only to AND gates 222, 224 and 228 which are not enabled, none of the Triacs are turned on during the e output interval.

The f output interval is furnished to the reset select AND gate 232 which is enabled so that the reset signal is generated at the f output interval. The sequence in the mode 3 operation is L1, L1L2, L1L2L3, L1L2L3L4, OFF and repeat. The mode 4 output of the sequencer control differs from that of mode 3 in that reset select AND gate 228 is enabled rather than gate 232 so that the e output of the counter/decoder furnishes the reset pulse to provide a sequence of L1, L1L2, L1L2L3, L1L2L3L4 and repeat.

Figure 7:
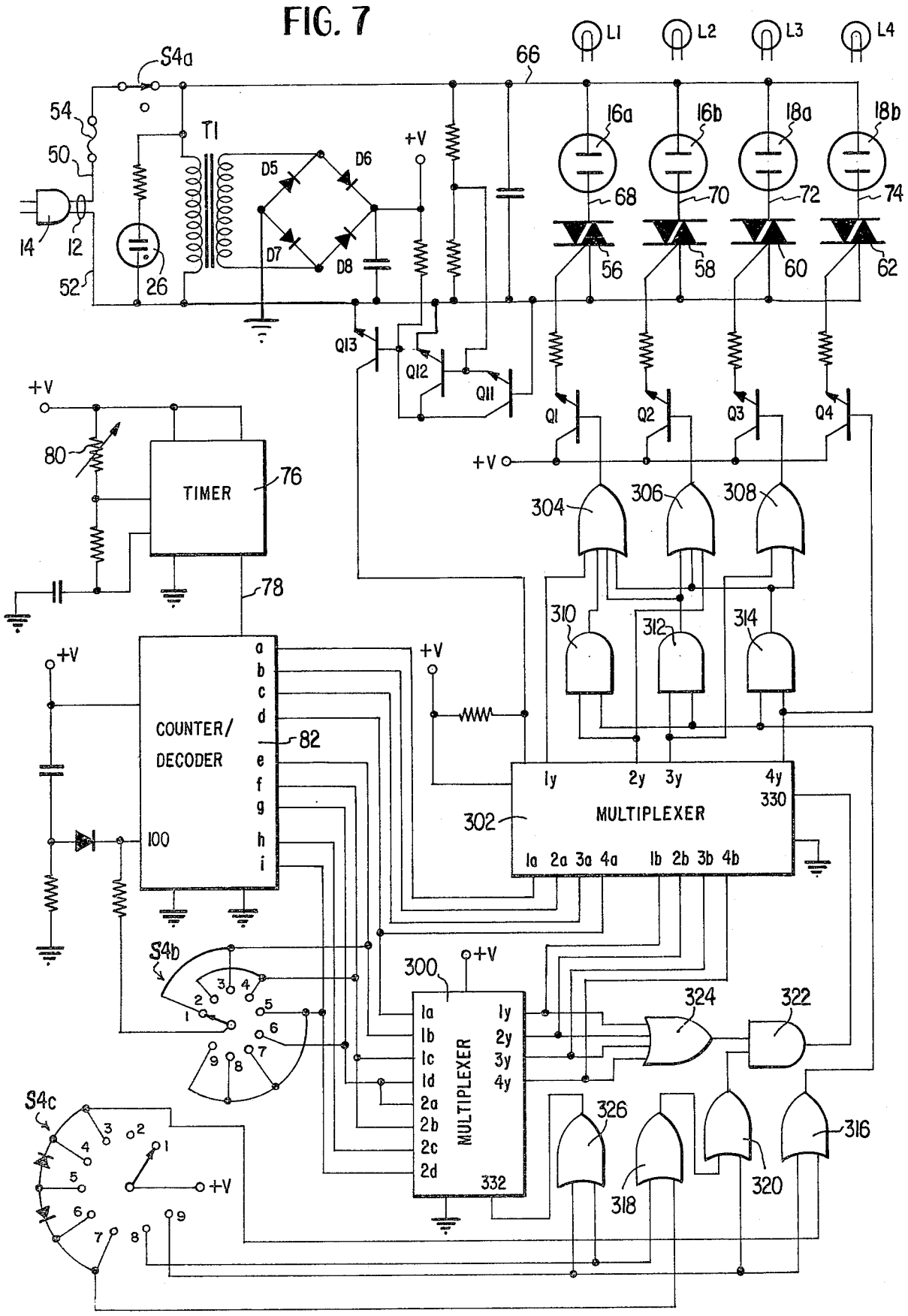
FIG. 7 is a schematic showing of yet another embodiment of the sequencing control circuitry.

Turning now to FIG. 7, there is disclosed a further modification of the sequencing control circuit of the present invention which provides for nine different sequencing modes and which employs a pair of quad 2-input multiplexers such as Model MM74C157 manufactured by National Semi-Conductor. Each of the multiplexers 300, 320 has four a inputs, 1*a*–4*a*, four b inputs, 1*b*–4*b*, and four output terminals, 1*y*–4*y*. Each multiplexer also includes a select terminal 330, 332, respectively, and functions to transmit an a input to the corresponding output in the absence of a control input signal at the select terminal and to transmit the b input signal to the corresponding y output terminal when a select signal is present. The circuit of FIG. 7 also includes OR gates 304–308, AND gates 310–312 and OR gate 316 for determining the sequencing pattern by which signals are transmitted from the multiplexer 302 to bias on the transistors Q1–Q4 and, in turn, the Triacs 56–62. OR gates 318, 320, AND gate 322 and OR gate 324 serve to control the generation of the select signal to the select input terminal 330 of multiplexer 302 while OR gate 326 controls the generation of the select signal to the select terminal 332 of multiplexer 300. In this embodiment, the mode select switch S4 includes an on-off switch S4*a* and two nine-position switches, S4*b* and S4*c*, which serve, respectively, to select the reset point for the counter/decoder 82 and the enabling signals to the gates. This circuit further includes a zero crossing detector network comprised of transistors Q11 and Q12 which serve, through transistor Q13, to provide an enable signal to the enable input 15 of the multiplexer 302. The multiplexer 302 is designed such that an output is generated only if no enable signal is present. Thus, the zero crossing detector network serves to assure that the outputs of the multiplexer 302 are provided only at those points at which the AC power signal is at a zero crossing point to again minimize radio frequency interference that would otherwise be caused by the sequencing control circuit.

When operating in the mode 1 position of the switches S4*b* and S4*c*, the e output of the counter/decoder 82 furnishes the reset signal through the reset input 100 and enabling signals are provided to the gates 310–320 and 326. As no signal is supplied to the gate 320, AND gate 322 is not actuated and the select signal to multiplexer 302 is at zero level. Likewise, since the gate 326 is not energized, the select signal to the multiplexer 300 is at the zero level. Thus, each of the multiplexers outputs the a input to the corresponding y output. In this mode, the a output of the counter/decoder 82 is supplied through the 1*y* output of multiplexer 302 to OR gate 304 to bias on transistor Q1; the b output, through a similar path, to OR gate 306 to bias on transistor Q2; the c output, to OR gate 308 and transistor Q3; the d output, to transistor Q4. While the d output also provides an output at the 4*y* terminal of multiplexer 300, this output is not multiplexed through the multiplexer 302 since the b inputs are inactive at this time and, while OR gate 324 is enabled by the output of multiplexer 300, AND gate 322 is not enabled so that no output of this AND gate is generated. The mode 1 sequence is thus L1, L2, L3, L4 and repeat. The mode 2 sequence differs from the mode 1 sequence in that the reset signal is derived from the f output of the counter/decoder and in that the e output of counter/decoder 82 represents an off interval for the lights so that the sequence in the mode b operation is L1, L2, L3, L4, OFF and repeat. In the mode 3 position of the switches S4*b* and S4*c* the reset signal is again derived from the e output of the counter/decoder coder 82 but OR gate 316 is enabled to provide one enabling input to each of AND gates 310–314. As a consequence, the a output of the counter/decoder, through the 1*y* output of multiplexer 302, enables OR gate 304; the b output energizes OR gate 306 and AND gate 310 which, in turn, furnishes an enabling signal to OR gate 304; output c enables OR gate 308 and AND gate 302 which, in turn, enables OR gates 304 and 306; and output d biases on transistor Q4 and enables AND gate 314 to furnish enabling signals to OR gates 304, 306 and 308. The sequencing mode here is L1, L1L2, L1L2L3, L1L2L3L4 and repeat. The number 4 mode of operation is identical to that of mode 3 except that the reset signal to the counter/decoder 82 is again derived from the f output and the e output represents an off period thus providing a sequence of L1, L1L2, L1L2L3, L1L2L3L4, OFF and repeat. When the switches S4*b* and S4*c* are in the number 5 position the reset signal to counter/decoder is derived from the i output and both OR gates 316 and 318 are enabled. Enabling of the OR gate 318 also enables OR gate 320 to provide one enabling input to AND gate 322. The operation in this mode is identical to that of the two previously described modes for the first three outputs of the counter/decoder 82. The d output of the counter/decoder provides an input to the 4*a* input of the multiplexer 300 which furnishes an output at the 4*y* terminal of this multiplexer. The 4*y* output of the multiplexer 300 provides an input to OR gate 324 to enable this gate and provide a second enabling signal to AND gate 322. As a result, the select input of multiplexer 302 goes from the zero to the one state so that the b inputs of the multiplexer 302 are now transmitted to the 4*y* output of the multiplexer 302 and serves to bias on transistor Q4 and to provide a second enabling input to each of AND gates 310, 312 and 314 to, in turn, enable OR gates 304, 306 and 308, respectively. The e output of counter/decoder 82 is multiplexed through multiplexer 300 to the 3*y* output of this multiplexer and through the multiplexer 302 to the 3*y* output of this multiplexer thus providing an enabling signal to OR gate 308 and to AND gate 312 which, in turn, provides enabling signals to OR gates 306 and 308. The g output of counter/decoder 82 furnishes the 1*y* output of multiplexer 302 to enable gate 304. Since the h output of counter/decoder 82 provides only a b input to multiplexer 300 and the select signal input of this multiplexer is at the zero level, the h output of counter/decoder 82 represents an off period in the cycle. The sequencing mode provided here is L1, L1L2, L1L2L3, L1L2L3L4, L1L2L3, L1L2, L1, OFF and repeat.

The number 6 position of switches S4*b* and S4*c* provide for the g output of the counter/decoder 82 to function as the reset signal and provide an enabling signal to OR gate 318 and gate 320. The output sequence in this mode is L1, L2, L3, L4, L3, L2 and repeat.

The number 7 position of the switches S4*b* and S4*c* differs from the number 6 position only in the selection of the reset signal to the counter/decoder 82 and serves to provide an off period between the end of one sequence and the beginning of the repeating sequence.

In the number 8 position of the switches S4*b* and S4*c*, the i output of counter/decoder 82 produces the reset signal to this unit and OR gates 318 and 326 are enabled. Since OR gate 326 is enabled, the select input of multiplexer 300 is at the 1 level so that the a inputs to this multiplexer are ignored while the b inputs are connected to the corresponding y outputs. Since OR gate 316 is not actuated, no enabling signals are provided to the AND gates 310, 312 and 314. A sequence of L1, L2, L3, L4, OFF, L4, L3, L2 and repeat is provided by the number 8 position.

The number 9 position of the switches S4*b* and S4*c* differs from the 8 position in that gate 316 and gate 320 are enabled while gate 318 is not. Since gate 316 is enabled, enabling signals are provided to the AND gates 310, 312 and 314 to produce a sequence L1, L1L2, L1L2L3, L1L2L3L4, OFF, L1L2L3L4, L1L2L3, L1L2 and repeat.

While, in each of the sequencing circuit embodiments described above four output receptacles are provided and the sequences involve for lights or banks of lights, the invention is not limited to such an arrangement. Rather, the gating networks may be expanded as desired to control any number of outlets and any number of lights. Also, additional sequencing patterns may be provided by suitable rearrangement of the gating networks. It should also be understood that while specific circuit components have been identified, components of other manufacturers may be substituted. It is also contemplated that, while the disclosed circuits employ both integrated circuit and discreet circuit elements, the entire circuit is amenable to integrated circuit manufacture. As these and other changes and additions may be made to the disclosed embodiments, reference should be had to the appended claims in determining the true scope of the invention.

What is claimed is:

1. A device for energizing a plurality of lights sequentially comprising:

first and second power buses;

means for connecting said buses to a power source;

a plurality of outlet receptacles each having first and second terminals adapted for connection to at least one of said plurality of lights, said first terminal of each receptacle being electrically connected to one of said power buses;

a solid state switching device for each receptacle, each said switching device having a pair of main terminals and a gating terminal, one of said main terminals being electrically connected to said second terminal of said corresponding receptacle and the other of said main terminals being electrically connected to the other of said power buses;

gating circuit means associated with each said switching device for furnishing a gating signal to said gating terminal in response to an enabling signal to said gating circuit means;

timing circuit means for generating timing pulses at uniformly spaced time intervals;

stepping circuit means having an input terminal receiving said timing pulses, a reset signal input terminal and a plurality of output terminals, said plurality of terminals being greater in number than said plurality of outlet receptacles, said stepping circuit means being operable to energize a single output terminal during the interval between successive timing pulses, beginning with a first output terminal and progressing to successive ones of said output terminals at successive timing pulses and operable to revert to said first output terminal upon receipt of a reset signal; and connecting circuit means including at least one manually operable switch for connecting said stepping circuit output terminals to said gating circuit means for furnishing enabling signals thereto and to said reset signal input terminal for furnishing a reset signal thereto, said connecting circuit means providing, for each gating circuit means, at least one enabling signal path between said gating circuit means and an output terminal of said stepping circuit means different from the output terminals to which the remaining gating circuit means are connected, for at least certain of said gating circuit means, additional enabling signal paths between said gating circuit means and said output terminals of said stepping circuit means, and, for said reset signal input terminal, at least one reset signal path from at least one of said output terminals of said stepping circuit means, at least certain of said enabling signal paths, additional enabling signal paths and reset signal paths extending through said manually operable switch whereby different ones of said signal paths are completed depending upon the position of said manually operable switch.

2. The device of claim 1 wherein said timing circuit means is adjustable to vary the duration of said time intervals.

3. The device of claim 1 wherein said power source is an alternating current power source and said device further includes a zero crossing detector circuit operating in conjunction with said gating circuit means whereby said gating signals are furnished only at the zero crossing points of the alternating current.

4. The device of claim 1 wherein N outlet receptacles are provided, said firstmentioned enabling signal paths connecting said gating circuits, respectively, to the stepping circuit means output terminals energized during the first N time intervals, said additional enabling circuit paths connecting at least certain of said gating circuit means to additional ones of said output terminals of said stepping circuit means.

5. The device of claim 4 wherein said manually operable switch controls said reset signal paths.

6. The device of claim 5 wherein said timing circuit means is adjustable to vary the duration of said time intervals.

7. The device of claim 1 wherein at least certain of said enabling signal paths include AND gates, said manually operable switch furnishing a control input to certain of said AND gates, the particular AND gates receiving control inputs varying with different positions of said manually operable switch.

8. The device of claim 7 wherein said timing circuit means is adjustable to vary the duration of said time intervals.

9. The device of claim 7 wherein additional AND gates are provided in said reset signal paths, said manually operable switch also determining the ones of said additional AND which receive control inputs.

10. A device for sequentially energizing a plurality of electrical outlet receptacles adapted for connection to conventional light means comprising:

first and second power buses;

means for connecting said buses to a power source;

a plurality M of outlet receptacles each having first and second terminals, all of said first terminals being electrically connected to one of said buses;

a solid state switching device for each receptacle, each said switching device having a pair of main terminals and a gating terminal, one of said main terminals being electrically connected to the second terminal of the corresponding one of said outlet receptacles and the other of said main terminals being electrically connected to the other of said buses;

gating circuit means associated with each said solid state switching device for furnishing a gating signal to said gating terminal in response to an enabling signal to said gating circuit means;

timing circuit means for generating timing pulses at uniformly spaced time intervals;

stepping circuit means having an input terminal receiving said timing pulses, a reset signal input terminal, and a plurality N of output terminals, N being greater than M, said stepping circuit means being operable to energize a single output terminal during the interval between successive timing pulses, beginning with a first output terminal and progressing to successive ones of said output terminals at successive timing pulses, the Nth output terminal being connected to said reset signal input terminal to cause said stepping circuit to revert to said first output terminal following the Nth timing interval; and connecting circuit means including a manually operable switch and providing signal paths for connecting the first N-1 output terminals of said stepping circuit means to said gating circuit means for furnishing enabling signals thereto, at least certain of said signals paths extending through said manually operable switch whereby different ones of said signal paths are energized in accordance with the setting of said manually operable switch.

11. The device of claim 10 wherein said timing circuit means is adjustable to vary the length of said time intervals.

12. The device of claim 10 wherein said connecting circuit means includes AND gates in at least certain of said signal paths, said manually operable switch being connected to provide control inputs to at least certain of said AND gates, the particular ones of said AND gates receiving control inputs varying with different positions of said manually operable switch.

13. The device of claim 12 wherein said power source is an alternating current power source and said device further includes a zero crossing detector circuit operating in conjunction with said gating circuit means whereby said gating signals are furnished only at the zero crossing points of the alternating current.

14. The device of claim 13 wherein said timing circuit means is adjustable to vary the length of said time intervals.

15. A device for sequentially energizing a plurality of electrical outlet receptacles adapted for connection to conventional light means comprising:

first and second power buses;

means for connecting said buses to a power source;

a plurality M of outlet receptacles each having first and second terminals, all of said first terminals being electrically connected to one of said buses;

a solid state switching device for each receptacle, each said switching device having a pair of main terminals and a gating terminal, one of said main terminals being electrically connected to the second terminal of the corresponding receptacle, and the other of said main terminals being electrically connected to the other of said buses;

gating circuit means associated with each said solid state switching device for furnishing a gating signal to said gating terminal in response to an enabling signal to said gating circuit means;

timing circuit means for generating timing pulses at uniformly spaced timing intervals;

stepping circuit means having an input terminal receiving said timing pulses, a reset signal input terminal, and a plurality N of output terminals, N being greater than M, said stepping circuit means being operable to energize a single output terminal during the interval between successive timing pulses, beginning with a first output terminal and progressing to successive ones of said output terminals at successive timing pulses and operable to revert to said first output terminal upon receipt of a reset signal at said reset signal input terminal; and connecting circuit means including at least one manually operable switch for connecting said stepping circuit output terminals to said gating circuit means to provide enabling signal paths thereto and to said reset input terminal to provide reset signal paths thereto, said manually operable switch being connected to at least certain of said enabling signal paths and said reset signal paths whereby different ones of said enabling signal paths and reset signal paths are completed depending upon the position of said manually operable switch.

16. The device of claim 15 wherein each of said certain enabling signal paths includes at least one AND gate, said manually operable switch furnishing control inputs to said AND gates, the particular AND gates receiving control inputs varying with the position of said manually operable switch.

17. The device of claim 16 wherein said power source is an alternating current power source and said device further includes a zero crossing detector circuit operating in conjunction with said gating circuit means whereby said gating signals are furnished only at the zero crossing points of the alternating current.

18. The device of claim 17 further including an additional AND gate for each gating circuit means interposed in the enabling signal path to said gating circuit means, said zero crossing detector circuit furnishing a control input to each said additional AND gate.

19. The device according to claim 18 wherein said timing circuit means is adjustable to vary the duration of said time intervals.

20. The device of claim 15 wherein said connecting circuit means includes at least one multiplexer circuit means having a plurality of first inputs, a plurality of second inputs, a plurality of outputs and a select input and operable to transfer a signal from either a first input or a second input to an output in accordance with the presence or absence of a signal at said select input, a different signal path from said stepping circuit means being connected to each input of said multiplexer circuit and the outputs of said multiplexer circuit being connected to signal paths to said gating circuit means, said manually actuatable switch determining the presence or absence of said signal at said select input.

21. The device of claim 20 wherein said timing circuit means is adjustable to vary the duration of said time intervals.

22. The device of claim 20 wherein said connecting circuit means includes two said multiplexer circuit means each having N outputs and 2N inputs, the number of output terminals M of said stepping circuit means equalling 2N, N of said output terminals being connected to said signal paths connected to said first inputs of said firstmentioned multiplexer circuit means, one of said N output terminals and the remaining output terminals being connected to ones of the first and second inputs of the second multiplexer, the outputs of said second multiplexer being connected to the second inputs of said firstmentioned multiplexer, said manually actuatable switch also determining the presence or absence of the signal at the select input of said second multiplexer.

23. The device of claim 22 wherein said manually actuatable switch is a multipole, multiposition switch, one of said poles determining the presence or absence of said select inputs and another of said poles determining the one of said stepping circuit means output terminals which furnishes said reset signal.

24. The device according to claim 20 wherein said power source is an alternating current power source, said device further including a zero crossing detector circuit, and said multiplexer circuit means further includes an enable input and being operable to produce a signal at an output only in the presence of a control signal at said enable input, said zero crossing circuit furnishing said control signal.

* * * * *